US005209900A

United States Patent [19]

Nakamura et al.

[11] Patent Number: 5,209,900

[45] Date of Patent: May 11, 1993

[54] HIGH-FINENESS SHADOW MASK MATERIAL AND PROCESS FOR PRODUCING THE SAME

[75] Inventors: Shuichi Nakamura, Yasugi; Hakaru Sasaki, Matsue, both of Japan

[73] Assignee: Hitachi Metals, Ltd., Tokyo, Japan

[21] Appl. No.: 889,996

[22] Filed: May 29, 1992

[30] Foreign Application Priority Data

May 30, 1991 [JP] Japan ..... 3-127234

[51] Int. Cl.[5] ..... C22C 38/08

[52] U.S. Cl. ..... 420/94; 148/336; 148/621; 148/653

[58] Field of Search ..... 420/94; 148/336, 621, 148/653

[56] References Cited

U.S. PATENT DOCUMENTS 4,904,447 2/1990 Hanada ..... 148/336
5,002,619 3/1991 Tanda et al. ..... 148/336

FOREIGN PATENT DOCUMENTS 2520384 7/1983 France .
2637614 4/1990 France .
2641796 7/1990 France .
2668498 4/1992 France .
59-96245 6/1984 Japan ..... 148/336
61-19737 1/1986 Japan ..... 148/336

OTHER PUBLICATIONS

Memoires Et Etudes Scientifiques Revue De Metallurgie, No. 11, Nov. 1, 1990, pp. 689–699.

*Primary Examiner*—Deborah Yee
*Attorney, Agent, or Firm*—Finnegan, Henderson, Farabow, Garrett & Dunner

[57] ABSTRACT

A high-fineness shadow mask material comprising 33–40% by weight of Ni, 0.0001–0.0015% by weight of one or more of boron, magnesium and titanium, and the remainder consisting essentially of Fe, wherein the contents of sulfur and aluminum are confined to not more than 0.0020% and not more than 0.020% by weight, respectively, and a process for producing the material. The shadow mask material according to this invention is excellent in hot working property and in etching properties.

3 Claims, 3 Drawing Sheets

{100} : 90%
(COLD REDUCTION 85%)

{100} : 98%
(COLD REDUCTION 97%)

ETCHING FACTOR E.F = D/S

HIGH-FINENESS SHADOW MASK MATERIAL AND PROCESS FOR PRODUCING THE SAME

This invention relates to Fe-Ni alloys for high-fineness shadow mask, more particularly to a shadow mask material having excellent hot working property as well as improved etching properties and a process for producing such a material.

Recently, invar steel (Fe-36Ni alloy) having low thermal expansion property is being used with increasing popularity, in place of conventional aluminum killed steel (AK steel), for such applications as parts of general televisions, high-fineness displays and the like. However, it is known that Fe-Ni alloys, although having excellent low thermal expansion property, are poor in hot working property and also inferior to AK steel in etching properties.

For the improvement of hot working property of Fe-Ni alloys, addition of boron to the alloys has been proposed in, for instance, Japanese Patent Application Kokai (Laid-Open) Nos. 159157/85, 101116/90, 182828/90 and 54744/90. Also, since boron contained in the alloys is impediment to etching, removal of boron from the alloys by annealing in wet hydrogen gas was proposed in Japanese Patent Publication No. 38658/90.

Regarding etching properties, it is known that in the case of fine etching, such as etching for shadow mask, even slight geometrical variations of etching holes (variation in diameter of etching holes, unevenness of etched surface, etc.) may affect the formed mask quality and tend to cause defects in appearance such as mask irregularities. For overcoming this problem, it has been proposed in Japanese Patent Publication Nos. 32859/84 (corresponding to U.S. Pat. No. 4,528,246) and 9655/90 to regulate the crystallographic orientation of the material to enable high-density, high-precision and uniform formation of fine holes by photoetching.

Boron is indeed effective for improving hot working property as mentioned before, but in the case of high-fineness shadow mask which requires precision etching, if boron is added in the manner such as proposed in the above-mentioned Japanese patent applications, there arises the problem that the etched surface tends to become uneven in a delicate way to cause mask irregularities by the effect of intergranular chemical resist created by the biased deposition of boron at the grain boundaries.

For overcoming this problem, Japanese Patent Publication No. 38658/90 proposes to get rid of boron by annealing in wet hydrogen gas as mentioned above. However, as this deboronization treatment is a diffusing treatment, there are required a high temperature and a long time for the treatment, which is unfavorable in terms of energy saving. This treatment also involves various other problems; for example, the material surface may be oxidized by a slight amount of $O_2$ present in the annealing atmosphere to give baleful effect to the masking and etching operations.

Also, Japanese Patent Publication Nos. 32859/84 and 9655/90 propose a low thermal expansion alloy sheet in which more than 35% of {100} face is assembled on the sheet surface.

The present invention is intended to provide a high-fineness shadow mask material having excellent hot working property and etching properties and a process for producing such a material.

With the object of satisfying both requirements for hot working property and etching properties of Fe-36Ni alloys, the present inventors have made ardent studies on the effect of addition of not only boron but also other elements such as titanium and magnesium, the effect of impurity elements such as sulfur and aluminum, crystallographic orientation and other matters and, as a result, found out the optimal components and properties for a high-fineness shadow mask material and a process for producing such a material. The present invention has been attained on the basis of such novel findings.

Regarding first the composition, it was found that titanium and magnesium have an effect of addition similar to boron, and by confining the contents of sulfur and aluminum to not more than 0.0020% and not more than 0.020%, respectively, it becomes possible to maintain the hot working property improving effect even if the total amount of addition of boron, magnesium and titanium, which give adverse effect to etching properties as a quid pro quo for affording of corrosion resistance, is reduced down to about 0.0001% as shown in FIG. 1, and that the adverse effect of boron, magnesium and titanium on etching properties (causing mask irregularities) disappears when the total amount of addition of said elements is on the smaller value side of the borderline of 0.0015–0.0010%. (In FIG. 1, the critical amount of addition of these elements is given as 0.0015%). In short, it was found that both requirements for hot working property and etching properties could be satisfied at the same time by defining the contents of sulfur and aluminum to less than the specified values.

Further, as a result of intensive researches on anisotropy of form of etching holes in relation to the {100} orientation integration degree of the rolled surface and on the etching factor which is described later, the present inventors found that by defining the {100} orientation integration degree within a proper range, anisotropy of form of etching holes can be eliminated, the etching factor can be bettered and consequently etching properties can be markedly improved. More specifically, it was found that when the {100} orientation integration degree (%) of the rolled surface is defined in the range of 50–95%, anisotropy of form of each etching hole disappears and an etching factor (EF) of 2 or greater can be obtained as shown in FIG. 2. In this case, it is to be noted that when the total content of boron, titanium and magnesium is made less than 0.0015% below which any ill effect on etching properties, especially mask irregularities, is not caused, the integration degree can be decided only from the cold reduction regardless of the total content of boron, magnesium and titanium. That is, for deciding said integration degree, it merely needs to regulate the cold reduction in a specified range and there is no need of giving any regard to said content. This can simplify the decision of the production conditions. Thus, regulation of the (100} orientation integration degree (%) of the rolled surface in the present invention is decided from both aspects of anisotropy of form of etching holes and etching factor. Here, the etching factor (EF) is defined as: $EF=D/S$ wherein D and S are as designated in FIG. 4 (a sectional schema of etching operation).

Thus, the present invention provides a high-fineness shadow mask material comprising 33–40% by weight of Ni, 0.0001–0.0015% by weight of one of more of boron, magnesium and titanium, and the remainder consisting essentially of Fe, wherein the contents of sulfur and aluminum are restricted to not more than 0.0020% by weight and not more than 0.020% by weight, respectively; a high-fineness shadow mask material comprising 33–40% by weight of Ni, 0.0001–0.0015% by weight of one or more of boron, magnesium and titanium, and the balance consisting essentially of Fe, wherein the contents of sulfur and aluminum are restricted to less than 0.0020% by weight and less than 0.020% by weight, respectively, and the {100} orientation integration degree of the rolled surface is 70–95%; and a process for producing a high-fineness shadow mask material which comprises hot working a high-fineness shadow mask material of said chemical composition and subjecting the hot worked material to cold rolling of a reduction of 50–95% and at least one run of annealing at 600°–900° C. to make the {100} orientation integration degree of the rolled surface 70–95%.

The definitions of the numerical values featuring the present invention are based on the following reasons.

Regarding the Ni content, if it is less than 33% by weight, the austenite structure becomes unstable, while if said content exceeds 40% by weight, the coefficient of thermal expansion of the composition increases to make it unable to meet the requirement for low thermal expansion property. For these reasons, the Ni content is defined to be in the range of 33–40% by weight.

Boron, magnesium and titanium are the elements effective for improving hot working property. However, if the amount of one or more of boron, magnesium and titanium put together is less than 0.0001% by weight, there is produced no effect of improving hot working property, while if said amount exceeds 0.0015%, intergrannular chemical resistance of the crystal is elevated to impede uniform progress of etching by a $FeCl_3$ solution or the like, to cause mask irregularity, which comes from unevenness of the etched face owing to the bad etching properties. Therefore, the amount of one or more of boron, magnesium and titanium put together is defined to be 0.0001–0.0015% by weight. The optimal amount range of these elements is 0.0001 to 0.0010% by weight. Above-specified addition of boron, magnesium and/or titanium can almost perfectly eliminate the risk of causing mask irregularity.

Figure 1:
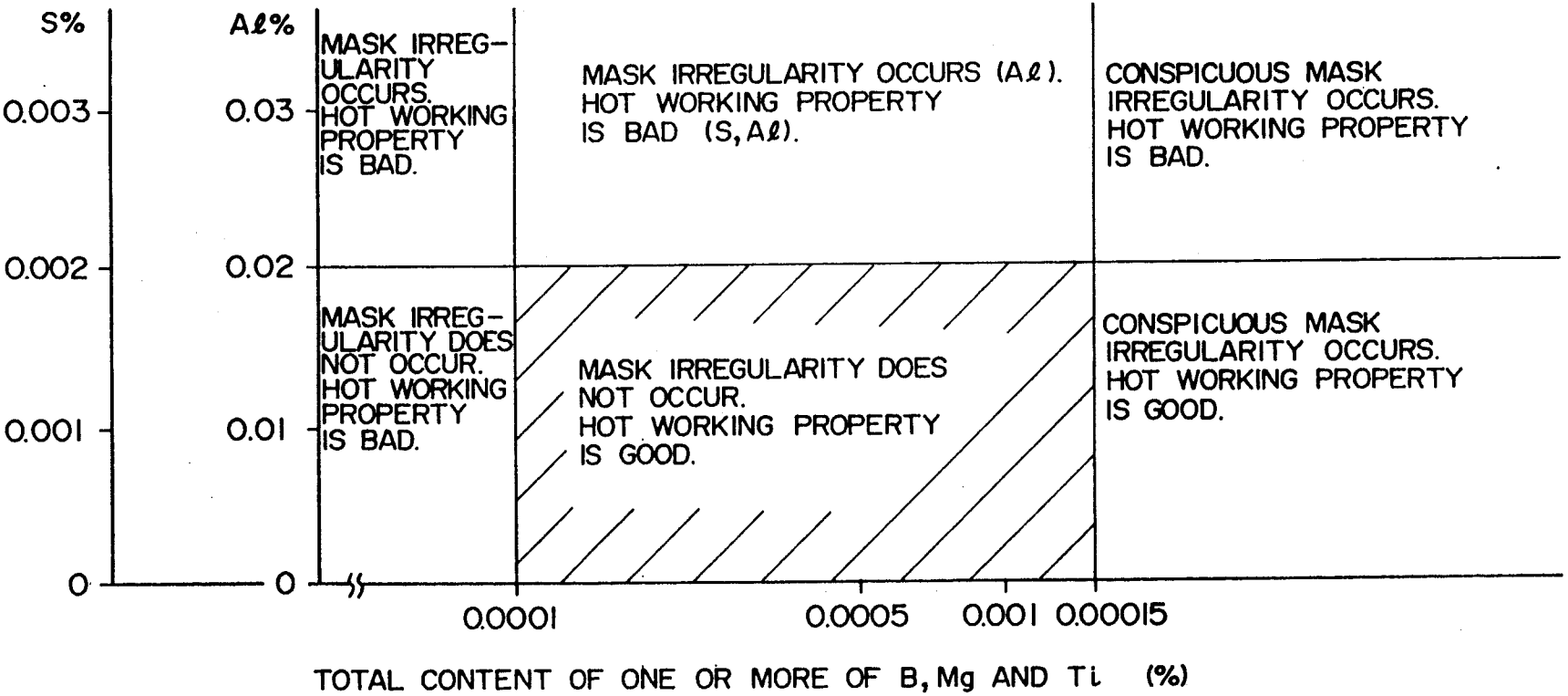
FIG. 1 is a graph showing correlation of the contents of boron, magnesium, titanium and aluminum, hot working property and etching properties.
Figure 2:
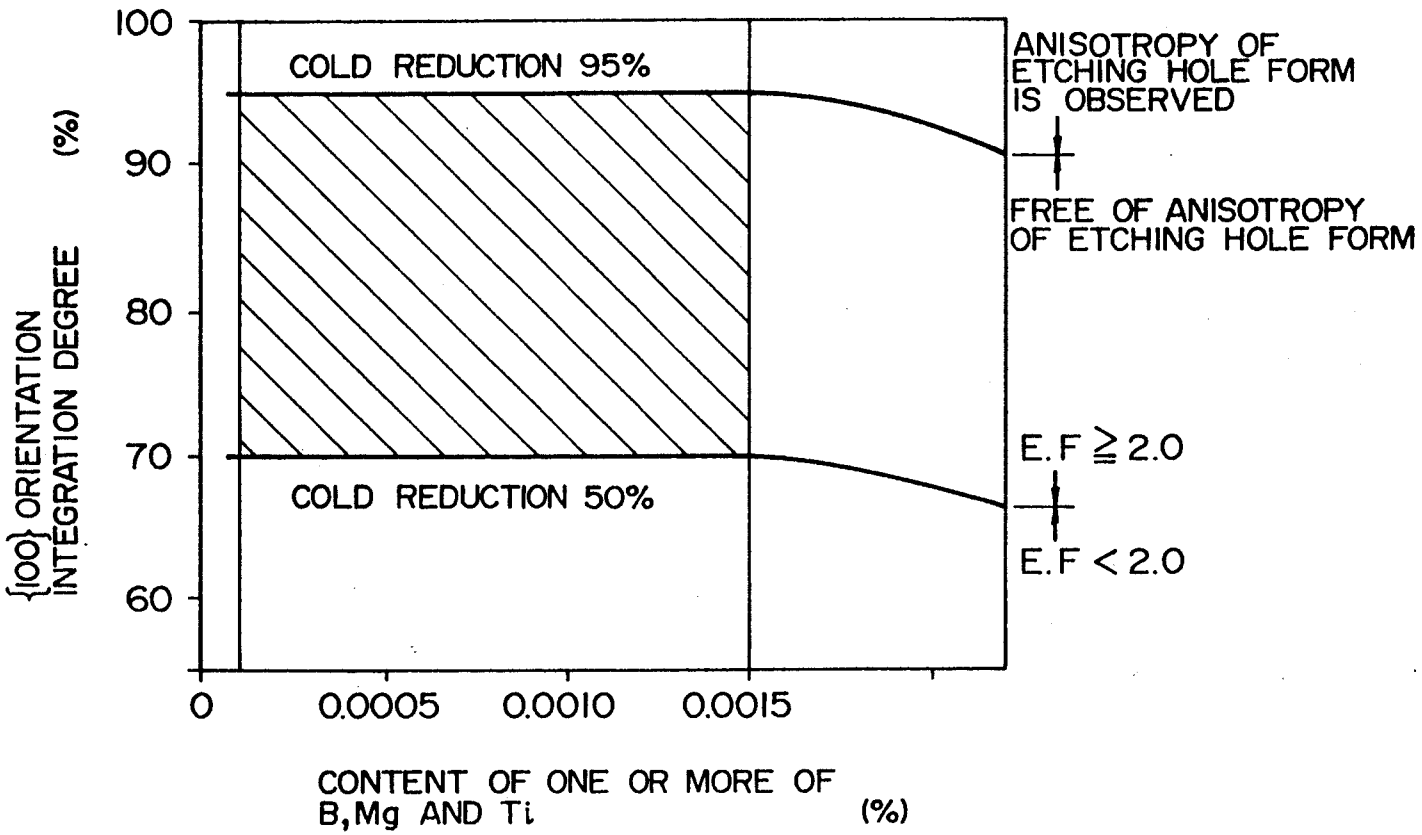
FIG. 2 is a graph showing correlation of {100} crystal orientation and etching properties to the contents of boron, magnesium and titanium.

As for sulfur and aluminum, if their contents exceed 0.002% and 0.02%, respectively, they reduce the hot working property improving effect by boron, etc., and also cause mask irregularities to deteriorate the etching properties as shown in FIG. 1. Accordingly, their contents should be less than 0.020% and 0.002%, respectively.

The content of boron, magnesium and/or titanium put together and the contents of sulfur and aluminum are confined within the hatched area in the graph of FIG. 1 because of their complementary relation.

If the cold reduction after hot rolling is less than 50%, the progress of {100} orientation is slow ({100}<70%) and also it is impossible to obtain a post-annealing etching factor (EF) of 2 or greater than 2 which is an index for the various elements in manufacture of shadow mask, such as the ratio of mutural interval of holes to sheet thickness. On the other hand, if the cold reduction exceeds 95%, {100} face is strongly orientated to an integration degree of higher than 95% to cause extraordinary anisotropy of form of etching holes and thus the form of the etching holes does not become a true circle. Therefore, the cold reduction is defined to the range of 50–95% while the {100} orientation integration degree is defined to the range of 70–95%.

Figure 3A:
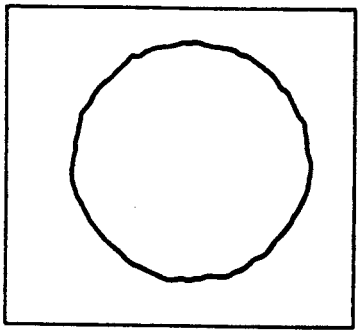
FIGS. 3A and 3B are schematic illustrations of anisotropy of etching.
Figure 3B:
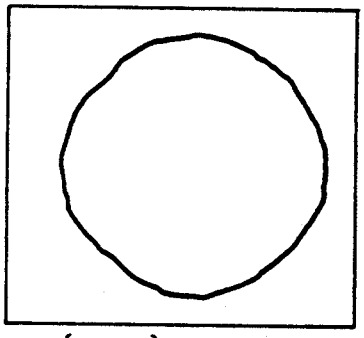
Figure 4:
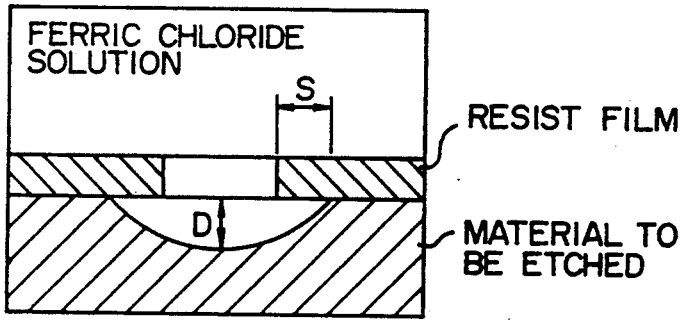
FIG. 4 is a schema illustrating the etching factor (EF).

FIGS. 3A and 3B are schematic illustrations of anisotropy of form of etching holes. As noted from the schemata, when the cold reduction and {100} orientation integration degree both exceed 95%, the anisotropy of form of etching holes becomes conspicuous.

When the annealing temperature after cold rolling is below 600° C., recrystallization is insufficient and growth of the {100} face is sluggish, so that there partially remains the fibrous structure formed at the time of rolling and the desired form of etching holes can not be obtained. When said annealing temperature is above 900° C., the crystal grains overgrow and the etching hole ends lack sharpness. The annealing temperature is therefore defined to the range of 600–900 C.

The annealing time is preferably not less than 60 seconds because otherwise there tends to arise nonuniformity of recrystallization. It is to be noted, however, that an unnecessarily prolonged annealing time leads to a reduction of mass productivity. The number of times of annealing after said rolling is decided by the cold reduction. After final annealing, there can be practiced rolling for tempering and stress relief annealing.

As described above, the first invention of the present application pertains to a high-fineness shadow mask material which is improved in hot working property and cleared of the adverse effects of boron, magnesium and titanium on etching properties by decreasing the amount of boron, magnesium and titanium which are detrimental to etching properties while also defining the contents of sulfur and aluminum in the specified ranges. The second invention provides an economical and high-quality shadow mask material having unprecedentedly excellent hot working property and etching properties, which was realized by further improving the etching properties and quality of said material of the second invention by the specific rolling and annealing operations which constitute the third invention of the present application.

EXAMPLES

The alloys of the compositions shown in Table 1 were melted in a vacuum induction melting furnace. The melts were then forged and hot worked at 1,100°–1,150° C. to form the hot rolled coils having a predetermined thickness. After pickling and polishing the surface, said coils were subjected to cold rolling and annealing at the cold reductions and temperatures shown in Table 2 to obtain the 0.15 mm thick sheet specimens. The hot working property and the results of the tests conducted on said specimens are shown collectively in Table 2.

TABLE 1

| No. | Chemical composition (wt %) Ni | S | Al | B | Mg | Ti | B + Mg + Ti | Remarks |
|---|---|---|---|---|---|---|---|---|
| 1 | 36.12 | 0.0004 | 0.012 | 0.0004 | — | — | 0.0004 | Materials according to the second invention |
| 2 | 36.05 | 0.0012 | 0.010 | 0.0012 | — | — | 0.0012 | |
| 3 | 35.95 | 0.0006 | 0.009 | 0.0006 | — | — | 0.0006 | |
| 4 | 35.88 | 0.0005 | 0.003 | 0.0005 | — | — | 0.0005 | |
| 5 | 36.51 | 0.0011 | 0.007 | 0.0011 | — | — | 0.0011 | |
| 6 | 35.93 | 0.0015 | 0.011 | 0.0015 | — | — | 0.0011 | |
| 7 | 36.03 | 0.0016 | 0.012 | — | 0.0008 | — | 0.0011 | |
| 8 | 35.98 | 0.0009 | 0.012 | 0.0005 | — | — | 0.0013 | |
| 9 | 35.97 | 0.0010 | 0.013 | — | — | 0.0012 | 0.0012 | |
| 10 | 36.11 | 0.0008 | 0.011 | — | 0.0007 | 0.0005 | 0.0012 | |
| 11 | 36.09 | 0.0013 | 0.010 | 0.0004 | — | 0.0004 | 0.0008 | |
| 12 | 36.12 | 0.0015 | 0.010 | 0.0007 | — | — | 0.0007 | Intermediate materials according to the first invention |
| 13 | 36.15 | 0.0010 | 0.015 | 0.0013 | — | — | 0.0013 | |
| 14 | 35.81 | 0.0008 | 0.011 | 0.0010 | — | — | 0.0010 | |
| 15 | 35.93 | 0.0011 | 0.008 | 0.0009 | — | — | 0.0009 | |
| 16 | 36.05 | 0.0009 | 0.011 | — | 0.0013 | — | 0.0013 | |
| 17 | 36.12 | 0.0010 | 0.012 | 0.0005 | 0.0007 | — | 0.0012 | |
| 18 | 36.01 | 0.0011 | 0.013 | — | 0.0008 | 0.0005 | 0.0013 | |
| 19 | 36.11 | 0.0012 | 0.012 | — | — | 0.0014 | 0.0014 | |
| 20 | 36.15 | 0.0010 | 0.012 | 0.0020 | — | — | 0.0020 | Comparative materials |
| 21 | 35.88 | 0.0023 | 0.013 | 0.0025 | — | — | 0.0025 | |
| 22 | 36.13 | 0.0025 | 0.029 | 0.0023 | — | — | 0.0023 | |
| 23 | 36.12 | 0.0011 | 0.011 | — | 0.0021 | — | 0.0021 | |
| 24 | 35.98 | 0.0025 | 0.024 | — | 0.0031 | — | 0.0031 | |
| 25 | 35.97 | 0.0009 | 0.015 | — | — | 0.0028 | 0.0028 | |
| 26 | 36.98 | 0.0026 | 0.029 | — | — | 0.0027 | 0.0027 | |
| 27 | 35.97 | 0.0027 | 0.010 | 0.0011 | — | — | 0.0011 | |
| 28 | 36.11 | 0.0007 | 0.024 | — | 0.0009 | — | 0.0009 | |
| 29 | 36.07 | 0.0028 | 0.021 | — | — | 0.0012 | 0.0012 | |

TABLE 2

| No. | Hot working property | Cold reduction (%) | Annealing temp. (°C.) | {100} system (%) | E.F | Etching properties: Anisotropy of hole form | Etching properties: Uniformity of mask | Remarks |
|---|---|---|---|---|---|---|---|---|
| 1 | Excellent | 93 | 800 | 94 | 2.4 | None | Excellent | Material according to the second invention |
| 2 | " | 85 | " | 89 | 2.4 | " | Good | |
| 3 | " | 72 | " | 82 | 2.2 | " | Excellent | |
| 4 | " | 55 | " | 73 | 2.1 | " | " | |
| 5 | " | 90 | 750 | 90 | 2.4 | " | Good | |
| 6 | " | 65 | 900 | 73 | 2.1 | " | " | |
| 7 | " | 85 | 800 | 90 | 2.4 | " | " | |
| 8 | " | 72 | " | 81 | 2.3 | " | " | |
| 9 | " | 85 | " | 90 | 2.4 | " | " | |
| 10 | " | 72 | " | 81 | 2.2 | | | |
| 11 | " | 85 | " | 91 | 2.3 | " | Excellent | |
| 12 | " | 98 | " | 97 | 2.2 | Observed | Bad | Intermediate materials according to the first invention |
| 13 | " | 45 | " | 65 | 1.8 | None | " | |
| 14 | " | 90 | 550 | 67 | 1.8 | " | " | |
| 15 | " | 90 | 1000 | 75 | 2.2 | " | " | |
| 16 | " | 98 | 800 | 98 | 2.1 | Observed | Bad | |
| 17 | " | 45 | " | 66 | 1.9 | None | " | |
| 18 | " | 90 | 550 | 67 | 1.8 | " | " | |
| 19 | " | 90 | 1000 | 77 | 2.1 | " | " | |
| 20 | " | 85 | 800 | 86 | 2.3 | " | " | Comparative materials |
| 21 | Bad | " | " | 83 | 2.2 | " | " | |
| 22 | " | " | " | 84 | 2.3 | " | " | |
| 23 | Excellent | " | " | 86 | 2.3 | " | " | |
| 24 | Bad | " | " | 79 | 2.1 | " | " | |
| 25 | Excellent | " | " | 81 | 2.2 | " | " | |
| 26 | Bad | " | " | 81 | 2.2 | " | " | |
| 27 | " | " | " | 89 | 2.4 | " | " | |
| 28 | " | " | " | 90 | 2.4 | " | " | |
| 29 | " | " | " | 91 | 2.4 | " | " | |

Hot rolling property was evaluated by the presence or absence of cracks in a slab. The {100} orientation integration degree was determined from the following formula (1) based on the relative intensity I in X-ray diffraction of main orientation of {111}, {100}, {110} and {311} planes:

$$D_{\{100\}}(\%) = \frac{I_{\{100\}}}{I_{\{111\}} + I_{\{100\}} + I_{\{110\}} + I_{\{311\}}} \times 100 \quad (1)$$

Etching properties were determined by measuring the etching factor (EF) and examining the presence or absence of anisotropy of etching hole form after hot degreasing the 0.15 mm thick blank sheet, subjecting it to photoresist masking of a predetermined pattern and spray etching with a $FeCl_3$ solution. Mask uniformity (quality) was judged by visual observation.

As seen from Table 2, alloy sample Nos. 1 to 19 according to the present invention were all excellent in hot working property as they contained one or more of boron, magnesium and titanium in an appropriate amount and were also reduced in sulfur and aluminum contents. Of these samples, Nos. 1 to 11, which were adjusted in {100} orientation integration degree to 70–95% by adjusting the cold reduction and annealing conditions, had EF of 2 or greater and were free from anisotropy of etching hole form and excessive mask irregularities and also rated good or excellent in etching properties.

Sample Nos. 1, 3, 4 and 11, in which the total content of boron, magnesium and titanium was less than 0.0010%, were excellent in uniformity of mask.

On the other hand, the materials according to the first invention of the present application were all excellent in hot working property, but sample Nos. 12 and 16, for which the cold reduction was deliberately raised to an excessive high of 98%, had a {100} orientation integration degree of 97% and 98%, respectively, and consequently anisotropy of etching hole form was conspicuous and mask uniformity was bad in these samples. Also, sample Nos. 13 and 17, for which the cold reduction was deliberately reduced to 45%, and sample Nos. 14 and 18, for which the annealing temperature was dropped to 550° C., all had a low {100} orientation integration degree of 65%, 66%, 67% and 67%, respectively, and consequently their etching factor (EF) was low (1.8 to 1.9) and also mask uniformity was bad. Further, in sample Nos. 15 and 19, for which the annealing temperature was raised excessively high, mask uniformity was bad and the etching hole ends didn't become sharp due to overgrowth of crystal grains.

Sample Nos. 20 to 29 of the comparative materials were all poor in etching properties due to mask irregularity because content of at least one of B, Mg, Ti, S and Al is higher than that specified in this invention. Sample Nos. 21, 22, 24 and 26–29, which were outside the specified range of value in content of one or both of S and Al, were poor also in hot working property.

As viewed above, the materials according to the first invention of the present application are improved in hot working property despite a decrease of the combined amount of B, Mg and Ti which are the hot working property improving elements, owing to confinement of the contents of S and Al within the specified ranges. These materials are therefore useful as intermediate materials for high-fineness shadow mask with excellent etching properties. The materials according to the second invention of this application are the high-fineness shadow mask materials of extremely high quality, provided with excellent etching properties while maintaining the {100} orientation integration degree in a proper range, which were realized by subjecting the materials of the first invention to the rolling and annealing treatments under the proper conditions according to the third invention. Thus, the inventions according to the present application have a large industrial effect.

What is claimed is:

1. A high-fineness shadow mask material comprising 33–40% by weight of Ni, 0.0001–0.0015% by weight of one or more of boron, magnesium and titanium, and the remainder consisting essentially of Fe, wherein the contents of sulfur and aluminum are confined to not more than 0.0020% and not more than 0.020%, respectively and the {100} orientation integration of the rolled surface is 70–95%.

2. A high-fineness shadow mask material according to claim 1, wherein the total amount of one or more of boron, magnesium and titanium is less than 0.0010% by weight.

3. A process for producing a high-fineness shadow mask material, which comprises hot working the high-fineness shadow mask material of claim 1, and then subjecting it to cold rolling at a reduction of 50–95% and at least one run of annealing at 600°–900° C. to make the {100} orientation integration degree of the rolled surface 70–95%.

* * * * *